US006863460B2

(12) United States Patent
Nicoll et al.

(10) Patent No.: US 6,863,460 B2
(45) Date of Patent: Mar. 8, 2005

(54) RESERVOIR PENS AND INK CARTRIDGES THEREFOR

(75) Inventors: Roy Nicoll, Wokingham (GB); Jon Winter, Wokingham (GB)

(73) Assignee: Sanford, L.P., Freeport, IL (US)

( * ) Notice: Subject to any disclaimer, the term of this patent is extended or adjusted under 35 U.S.C. 154(b) by 0 days.

(21) Appl. No.: 10/220,136

(22) PCT Filed: Mar. 1, 2001

(86) PCT No.: PCT/GB01/00889

§ 371 (c)(1),
(2), (4) Date: May 5, 2003

(87) PCT Pub. No.: WO01/64452

PCT Pub. Date: Sep. 7, 2001

(65) Prior Publication Data

US 2003/0165350 A1 Sep. 4, 2003

(30) Foreign Application Priority Data

Mar. 2, 2000 (GB) ..... 0005080

(51) Int. Cl.[7] ..... B43K 5/18
(52) U.S. Cl. ..... 401/235; 401/232
(58) Field of Search ..... 401/232–237

(56) References Cited

U.S. PATENT DOCUMENTS 271,455 A * 1/1883 Zepell ..... 401/235
3,187,724 A * 6/1965 Zepell ..... 401/235
5,222,824 A 6/1993 Nicoll et al.
5,735,624 A 4/1998 O'Connor et al.

FOREIGN PATENT DOCUMENTS

| | | |
|---|---|---|
| GB | 596262 | 12/1947 |
| GB | 2074104 | 10/1981 |
| GB | 2123351 | 2/1984 |
| GB | 2146588 | 4/1985 |
| WO | WO 98/51515 A3 | 11/1998 |
| WO | WO 98/51515 A2 | 11/1998 |

OTHER PUBLICATIONS

Copy of International Search Report for International Application No. PCT/GB01/00889, dated Jun. 26, 2001, 1 page.

* cited by examiner

*Primary Examiner*—David J Walczak
(74) *Attorney, Agent, or Firm*—Marshall, Gerstein & Borun LLP

(57) ABSTRACT

An ink cartridge (1) for a reservoir pen has a body (2) which encloses an ink-chamber (3) that is initially sealed near the front end of the cartridge by a closure formed by a plug (4). The plug (4) sealingly engages in an axial bore (5) which is open to the front end of the cartridge and is slidably mounted in the cartridge body (2) so as to be moved rearwardly by engagement with a peg (34) upon insertion of the cartridge (1) into a pen, thereby allowing ink flow from the ink chamber (3) through the bore (5) and to a writing tip (23) of a nib (22) of the pen. The peg (34) is sized so as to form a seal with the inner surface of the bore (3) when fully inserted thereinto.

17 Claims, 9 Drawing Sheets

RESERVOIR PENS AND INK CARTRIDGES THEREFOR

FIELD OF THE INVENTION

This invention relates to reservoir pens and in particular to ink cartridges for use in reservoir pens. It is, of course, well known to provide reservoir pens adapted to receive ink cartridges which are replaced when they become emptied of ink.

BACKGROUND OF THE INVENTION

In GB-A-2146588 there is described an ink cartridge with an internal valve assembly including a valve seat, and a valve member urged against the seat by a coil spring, the valve member being axially inwardly displaceable to open the valve to allow ink to flow out of the cartridge. Described in WO 01/64452 is an ink cartridge including an internal valve assembly including a valve seat and a resilient diaphragm separating a chamber, which is in communication with ambient atmosphere via an air port, and ink transfer chamber so that the diaphragm is deformed to open the ink path from the main ink chamber when there is a reduced pressure in the ink transfer chamber.

SUMMARY OF THE INVENTION

Provided in accordance with the present invention is an ink cartridge for a reservoir pen, comprising a body enclosing a chamber, an ink port through which, in use, ink delivered from the chamber is discharged from the cartridge, and a resilient valve element mounted on the body at the port for controlling flow of ink therethrough, the valve element having an open condition in which the port is opened, characterised in that the valve element is inwardly deformable.

By equipping an ink cartridge with a resilient valve element, in particular a moulded element formed of resiliently deformable material, the performance of a valve for controlling ink flow in the pen can easily be assured over a long term use of a reservoir pen since the valve element which may be susceptible to wear is then replaced each time a fresh ink cartridge is inserted into the pen. A valve for controlling ink flow to the pen nib can be desirable for example when a cartridge is adapted to hold a relatively large volume of ink.

The valve element which is carried by the cartridge body may be either a valve member for cooperation with a valve seat, in which case the seat can conveniently be defined by the cartridge body, or a valve seat in which case a valve member cooperable with the seat can be provided in the pen structure.

In one particular embodiment in which the valve member is carried by the cartridge, the valve member is integral with a spring which extends radially from the valve member and biases the valve member away from the seat. The outer end of die spring is attached to a support ring which extends around the valve member, there being openings for ink flow between the ring and valve member.

In a preferred embodiment of a cartridge having a valve element in the form of a valve seat, the valve seat comprises a disc with at least one aperture therein for ink to pass through when the valve is open.

The ink chamber is conveniently sealed at the forward end thereof by a closure which is opened on insertion of the cartridge into the pen in order to bring the discharge port into communication with the chamber. For this purpose the cartridge can have a bore into which a peg carried by the pen enters when the cartridge is loaded into the pen. In addition to opening the closure, e.g. by rupturing a closure diaphragm or displacing a closure plug, the peg conveniently serves to define an ink feed duct for conducting ink from the ink chamber to the discharge port, the peg being provided with a longitudinal groove for this purpose.

BRIEF DESCRIPTION OF THE DRAWINGS

The foregoing and other preferred features of the invention will become clear from the following detailed description of some embodiments of the invention, reference being made to the accompanying drawings, in which.

DETAILED DESCRIPTION

Figure 1:
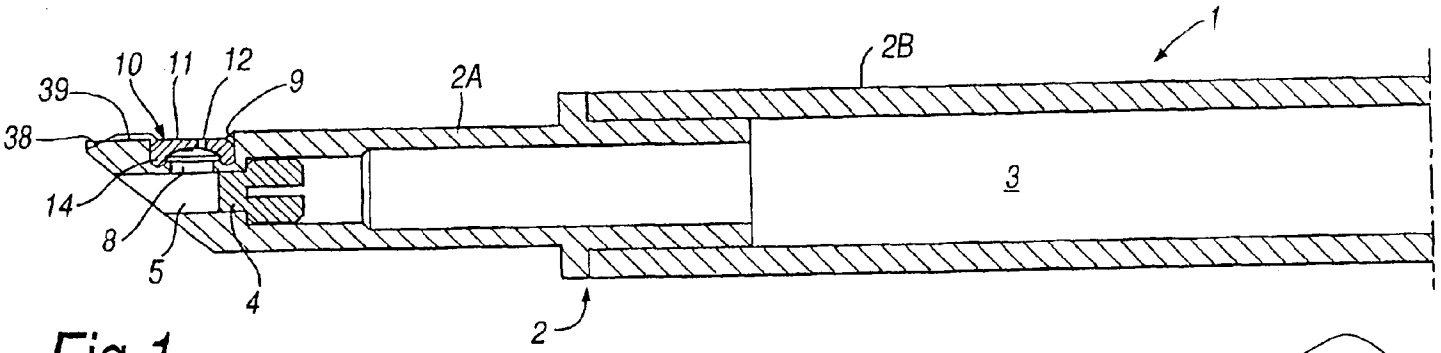
FIG. 1 is an axial cross-section through the forward end of an ink cartridge embodying the invention.
Figure 2:
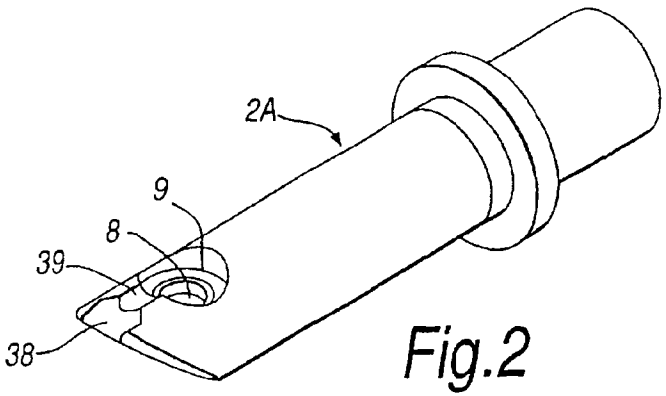
FIG. 2 is an isometric view showing the front end part of cartridge of FIG. 1.

Referring initially to FIGS. 1 to 8, an ink cartridge 1 constructed according to the invention has a body 2 shown formed in two parts 2A and 2B and generally cylindrical in configuration. The rear end of the cartridge is not shown in the drawings and it can be closed by an end wall, e.g. integral with the rear body part 2B, or an ink follower, such as a conventional grease plug may be included in order to provide a barrier between the ink contained in the cartridge and ambient air, the ink follower being drawn along die cartridge as the ink is used up in a manner known per se. The cartridge body 2 encloses an ink chamber 3 which is filled with ink, his chamber being initially sealed near the front end of the cartridge by a closure formed by a plug 4 which is sealingly engaged in an axial bore 5 which is open to the front end of the cartridge. The plug 4 is slidable in the cartridge body and can be displaced rearwardly from the position shown in FIG. 1 to open up communication between the chamber 3 and the bore 5 for flow of ink as will be explained in more detail later. An ink discharge port 8 extends through the side wall of the cartridge body, the inner end of the port 8 being open to the bore 5 and the outer end of the port opening at the bottom of an external circular recess 9 formed in the side wall of the body. Accommodated in this recess 9 is a valve element in the form of a valve seat 10 which is moulded from resiliently deformable material. The valve seat, as clearly shown in FIGS. 4–6, consists of a disc 11 in which three segment-shaped apertures 12 are provided and uniformly distributed around the centre of the disc. On its underside the disc 11 has a peripheral rim 14 which gives the valve seat a shallow cup-shape, and the edge of rim 14 sits in an annular groove formed in the bottom of the recess 9 around the ink discharge 8. The pen with which the cartridge is intended to be use has a barrel 20 (FIG. 3) shaped and dimensioned to receive the cartridge which is inserted from the rear, and a feed bar 21 which is shown integral with a front barrel section. A nib 22 having a writing tip 23 is carried on the feed bar 21 and is held in position by a collar 24. The feed bar 21 has a socket 26 which is positioned beneath the nib 22 and in which a valve member in the form of a ball 29 is received. A lip 30 is provided at the inner edge of the socket 26 so that the valve ball 29 is held captive between the nib 22 and the lip 30, but is free to move within the socket A capillary slot 31 extends longitudinally of the feed bar 21 for conducting ink to the underside of the nib 22 for delivery to the writing tip by means for a capillary slit or groove extending along the nib 22. An axially inwardly projecting peg 34 is formed on a front end wall 28 of the pen barrel, this peg having a free end portion 35 of reduced diameter.

Figure 3:
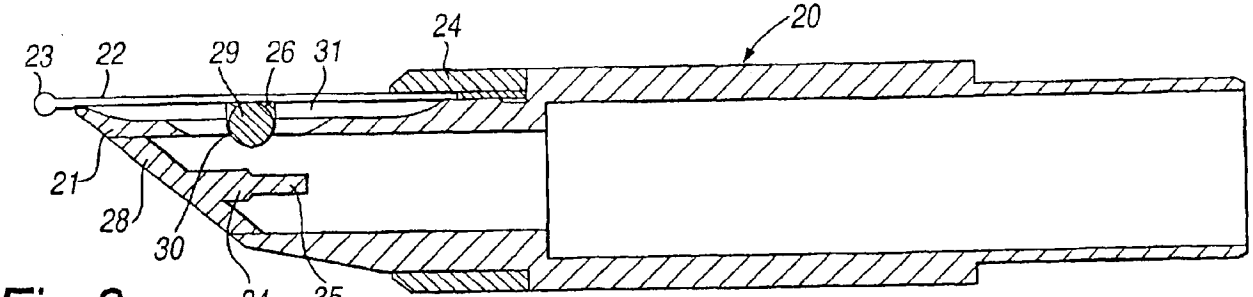
FIG. 3 is an axial cross-section through a pen with which the cartridge of FIG. 1 is intended to be used.
Figure 4:
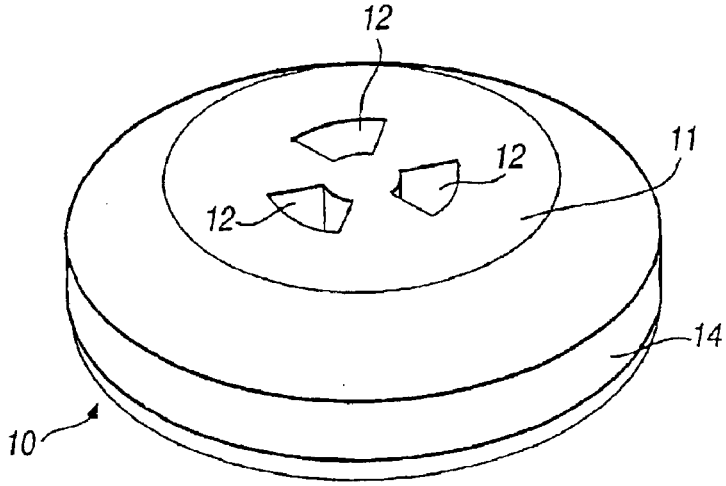
FIG. 4 is an isometric view showing the valve seat of the cartridge shown in FIG. 1.
Figure 5A:
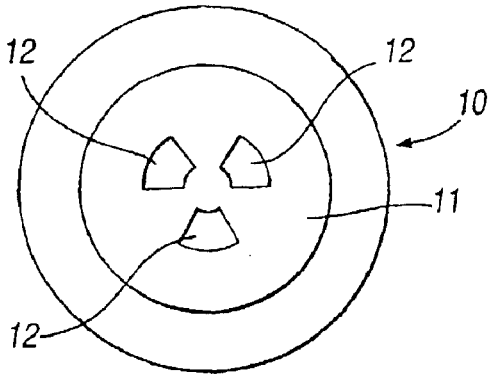
FIGS. 5A and 5B show the valve seat of FIG. 4 in plan and side elevation, respectively.
Figure 6:
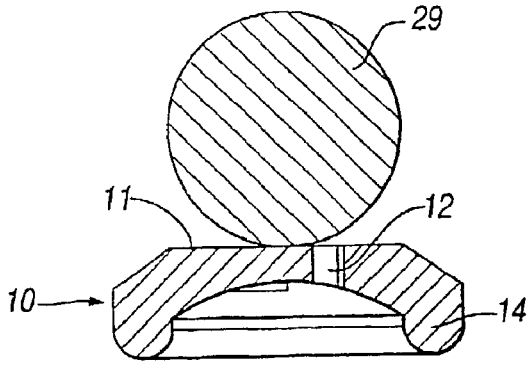
FIG. 6 is a cross-sectional view showing the valve seat in combination with the valve member of the pen.
Figure 5B:
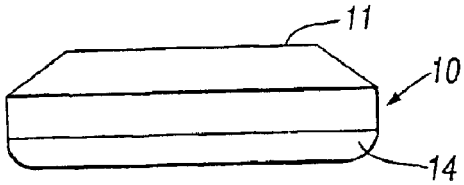
Figure 7A:
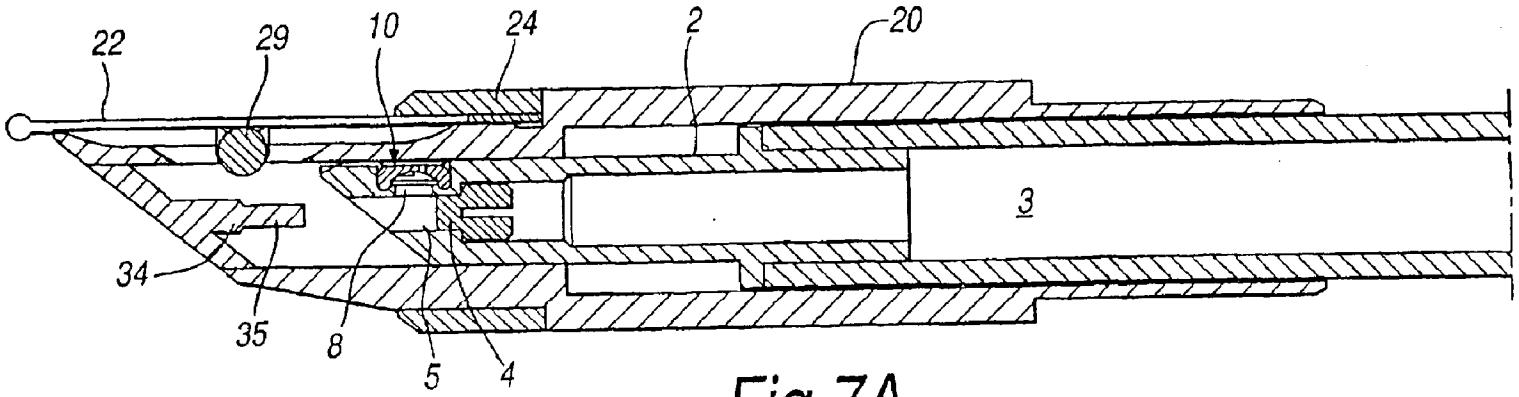
FIGS. 7A and 7B are axial cross-sections showing the cartridge of FIG. 1 in the course of being loaded into the pen of FIG. 3, and inserted fully into the pen, respectively.
Figure 7B:
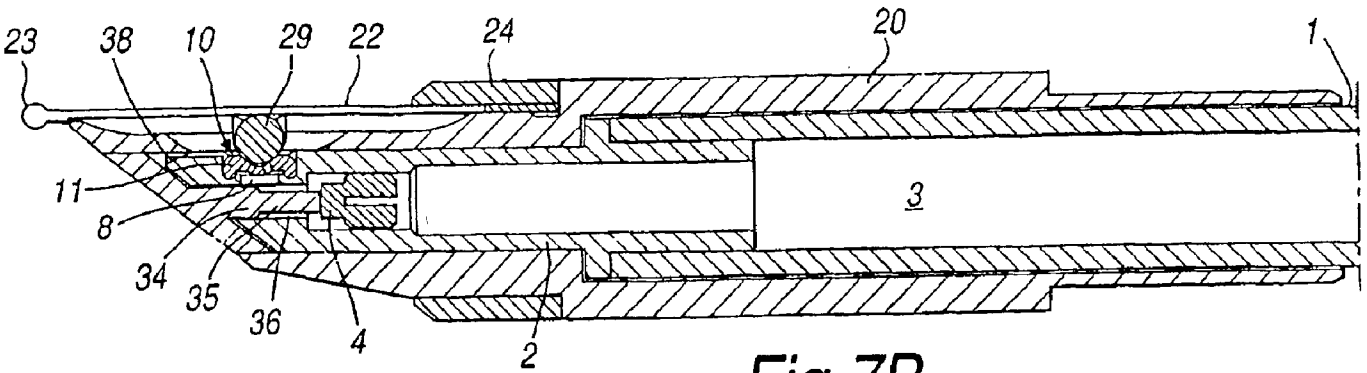
Figure 8:
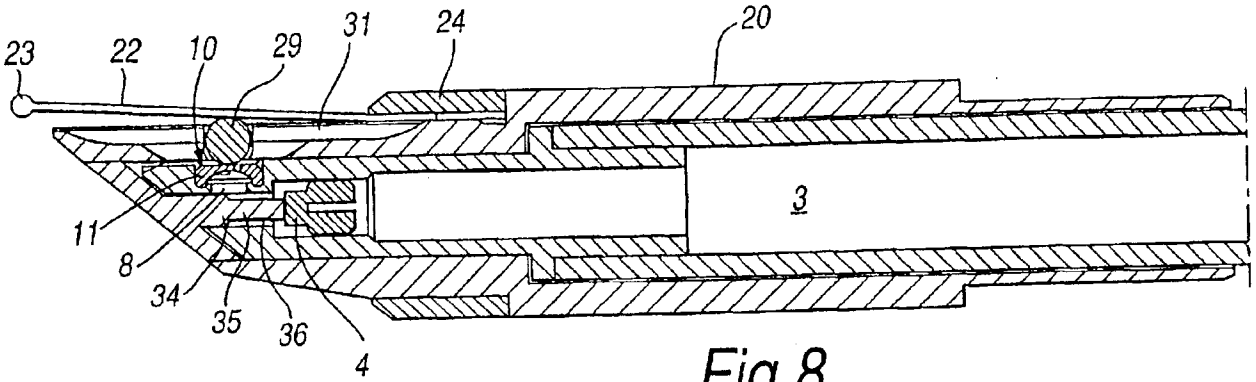
FIG. 8 is an axial cross-section corresponding to FIG. 7B, but illustrating a valve open condition of the pen.

FIG. 7A illustrates the ink cartridge 1 in the course of being inserted into the pen of FIG. 3. As the cartridge is pushed forwardly from the position in which it is shown, the peg 34 enters the bore 5 and eventually strikes against the plug 4. As the forward movement of the cartridge 1 continues, the plug 4 is displaced rearwardly relative thereto eventually becoming disengaged from the bore 5 so that communication becomes established between the ink chamber 3 and an annular ink feed duct 36 formed between the reduced diameter portion 35 of the plug and the wall of the bore 5. When fully inserted the peg 34 seals the open end of the bores. Furthermore, during the forward movement of the cartridge, a ramp 38 is provided at the forward edge of the cartridge body 2 is brought into contact with the valve ball 29 and lifts the ball which is then guided along a short groove 39 in the side wall of the cartridge behind the ramp 38 until the valve seat 10 of the cartridge is brought into aligned cooperation with the valve ball which occurs when the cartridge is fully inserted as shown in FIG. 7B. Under the pressure exerted by the nib which is resilient and urges the valve ball 29 inwardly, the disc 11 of the valve seat 10 becomes deformed by the ball 29 which is made of material harder than that of the seat, and a seal is established between the valve ball and the seat so that ink supplied to the discharge port 8 from the chamber 3 via the ink duct 36 is prevented from flowing to the nib 22 through the apertures 12 in the valve seat. When the pen is used, however, the writing tip 23 of the nib is pressed against the paper surface causing the nib 22 to be deflected away from the feed bar 21 as shown in FIG. 8, and he valve ball is then lifted by the inherent resilience of the valve seat 10, with the result that the disc 11 becomes flat again so that the sealing cooperation between the ball and seat is interrupted and ink can flow through the seat apertures 12 and into the capillary slot 31 of the feed bar 21 for delivery to the writing tip of the nib. When the nib is lifted from the paper the nib moves back against the feed bar and urges the valve ball 29 inwardly so that the valve becomes closed once again.

Figure 9A:
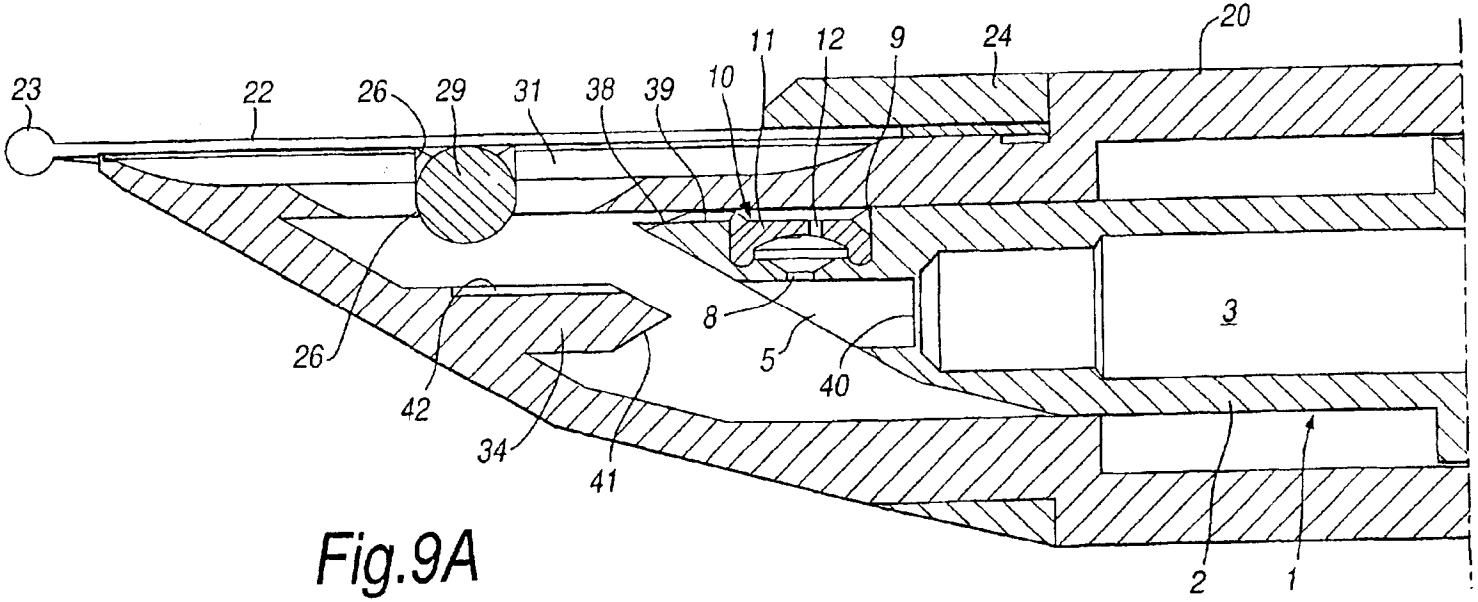
FIGS. 9A and 9B are axial cross-sections corresponding to FIGS. 7A and 7B, respectively and illustrating a modified form of cartridge in combination with a pen similar to that of FIG. 3.
Figure 9B:
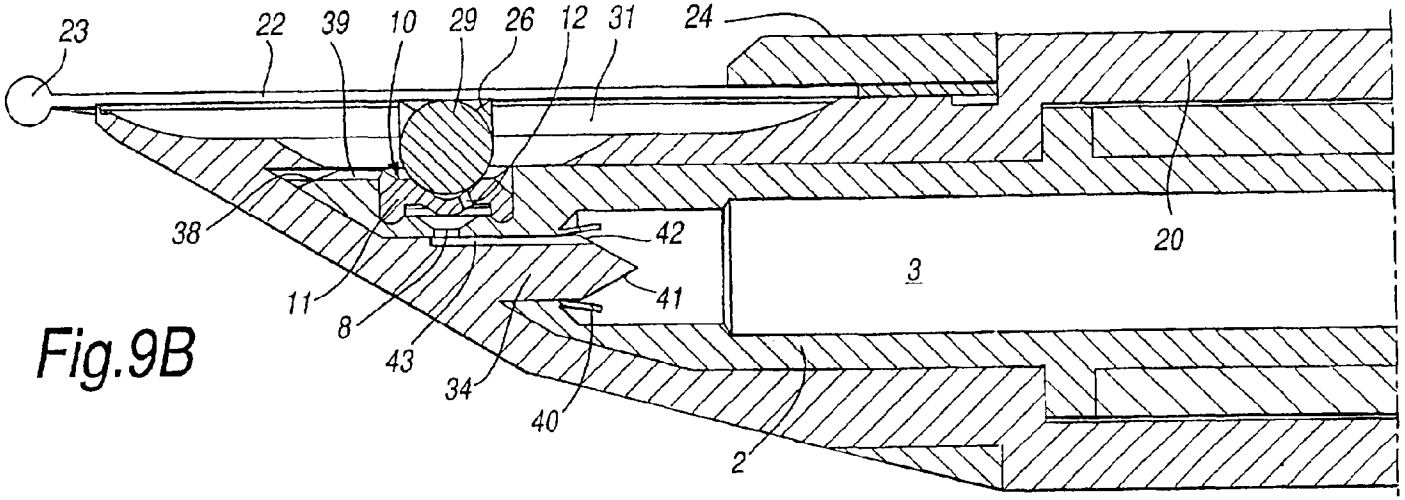

In FIGS. 9A and 9B another cartridge and pen are shown in combination and which for the most part are the same as those described with reference to FIGS. 1 to 8. In the drawings the same reference numerals have been used to denote corresponding parts. In place of a sealing plug, the cartridge has a diaphragm or membrane 40, conveniently formed integrally with the body of the cartridge, which serves as a closure between the ink chamber 3 and the bore 5. The peg 34 of the pen has a pointed free end 41 for piercing and rupturing the membrane 40 when the cartridge is introduced into the pen. Also, in this embodiment, instead of having a reduced diameter end portion the peg has a groove 42 which defines a channel 43 for communicating the ink chamber 3 with the discharge port 8.

Figure 10:
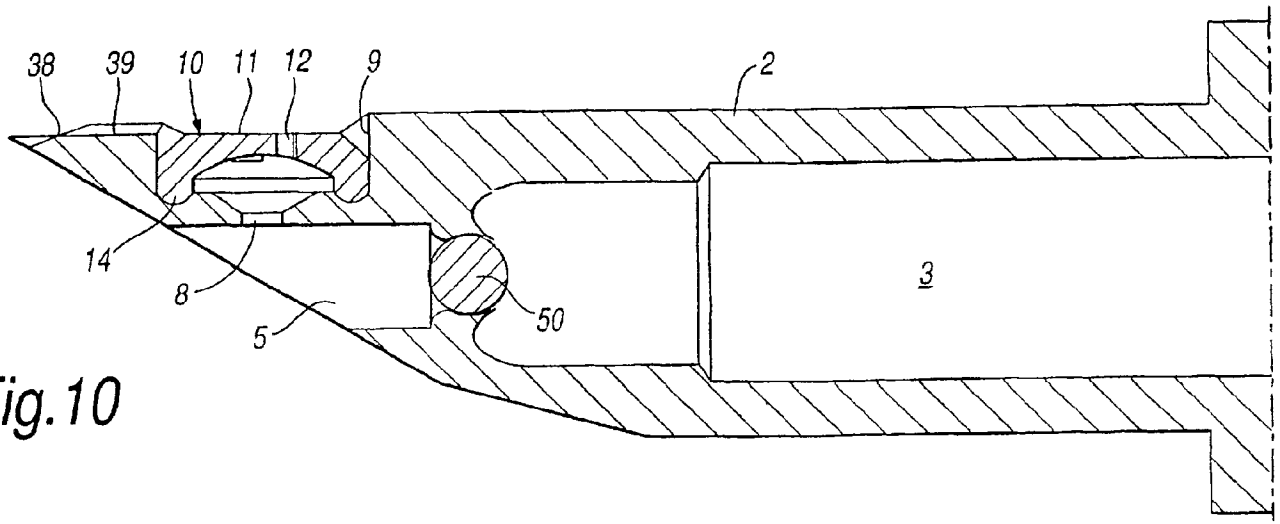
FIG. 10 is an axial section through another cartridge suitable for use with the pen of FIGS. 9A and 9B.
Figure 11:
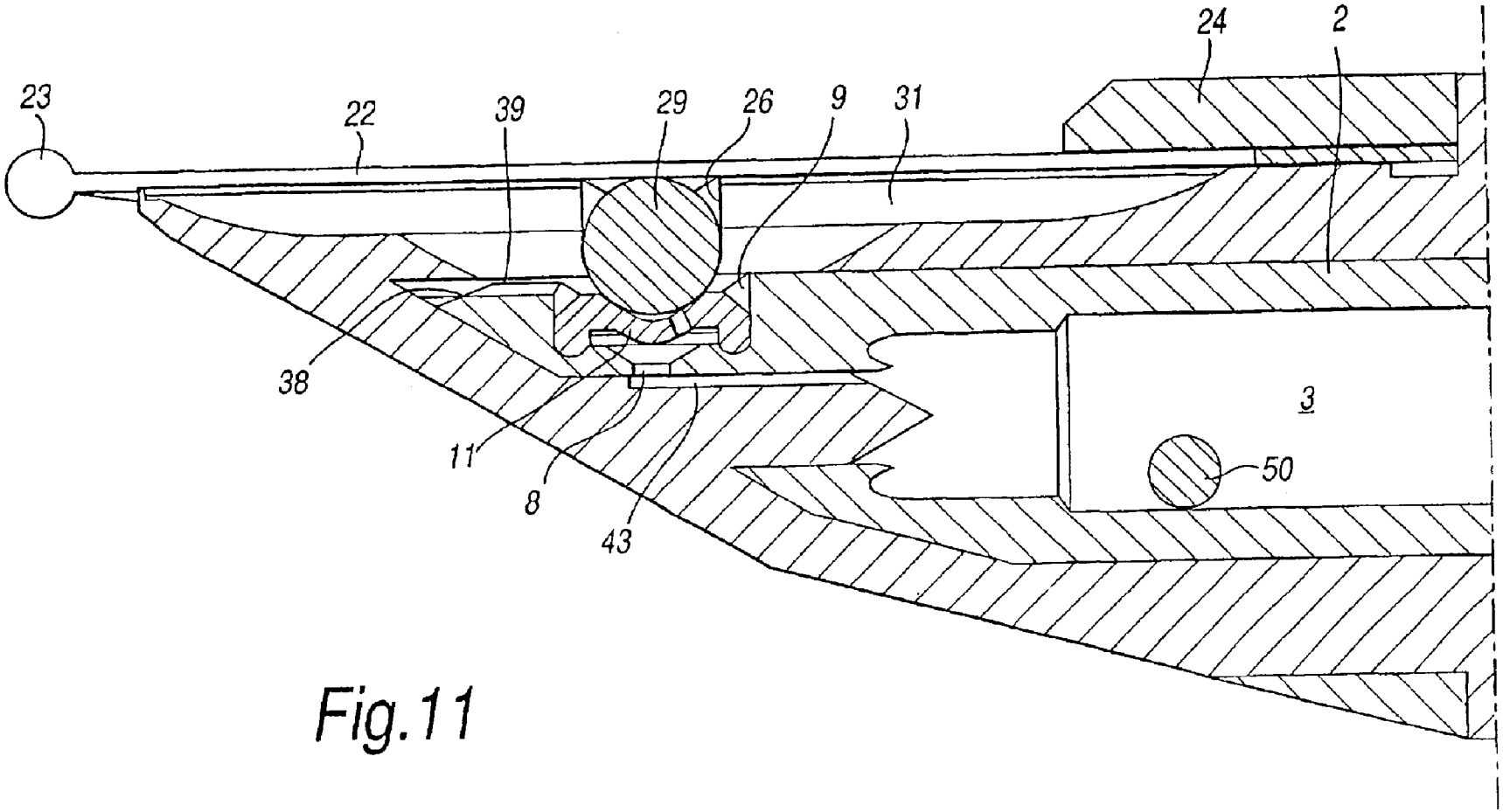
FIG. 11 shows in axial cross-section the cartridge of FIG. 10 inserted into the pen.

The ink cartridge illustrated in FIGS. 10 and 11 has a closure plug in the form of a ball 50, which ball becomes dislodged and displaced into the ink chamber 3 by the peg 34 of the pen when the cartridge is inserted into the pen as shown in FIG. 11.

Figure 12:
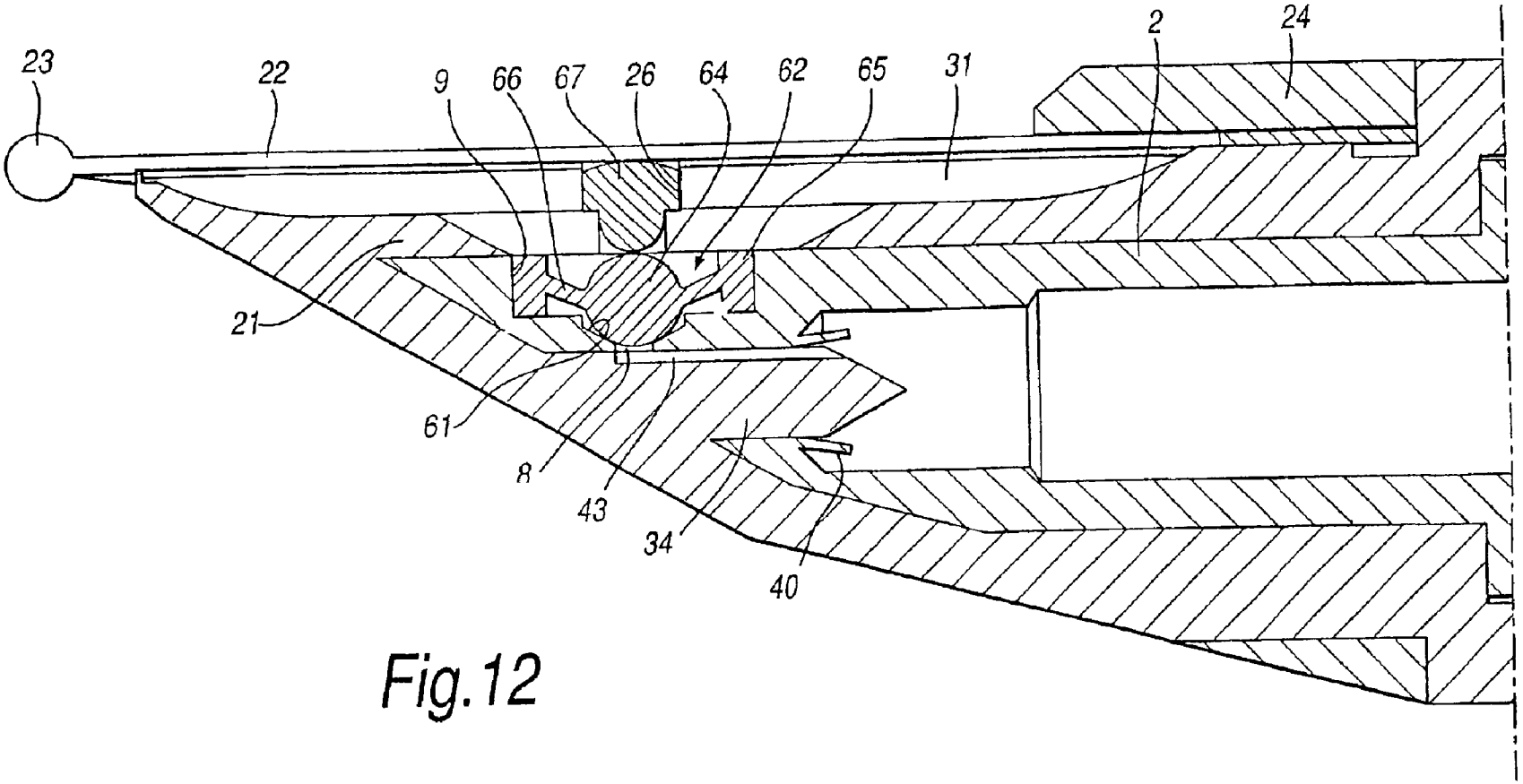
FIG. 12 is an axial cross-section showing an ink cartridge having a valve element in the form of a valve member, the cartridge being shown inserted in a pen with which the cartridge is adapted to be used.
Figure 13:
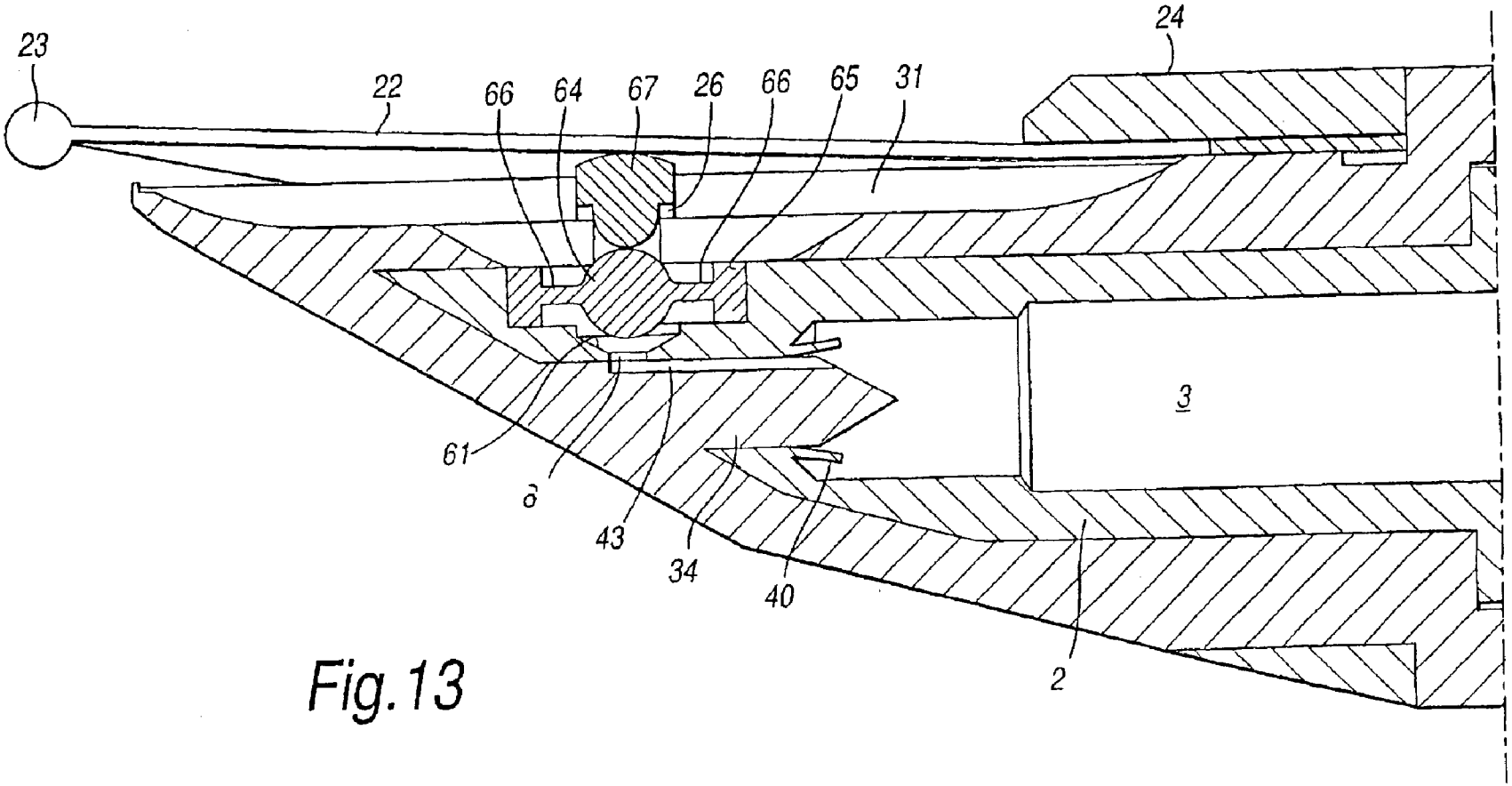
FIG. 13 is an axial cross-section corresponding to FIG. 12; but illustrating the valve in an open condition.
Figure 15C:
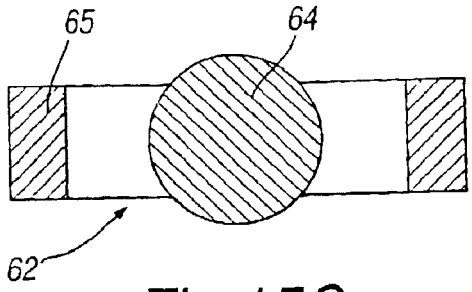
FIGS. 15A, 15B and 15C are a plan, a side elevation and a cross-section, respectively of the valve element of FIG. 14.
Figure 14:
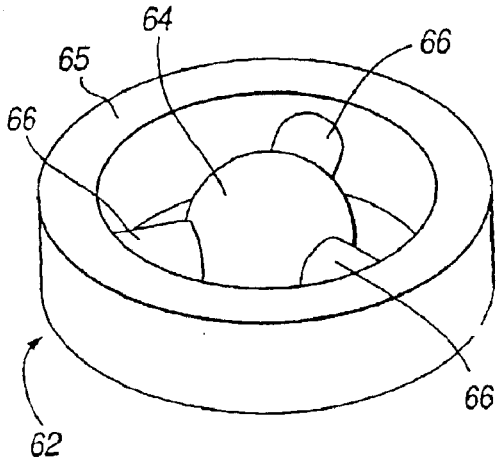
FIG. 14 is an isometric view of the valve element of the ink cartridge included in FIGS. 12 and 13.
Figure 15B:
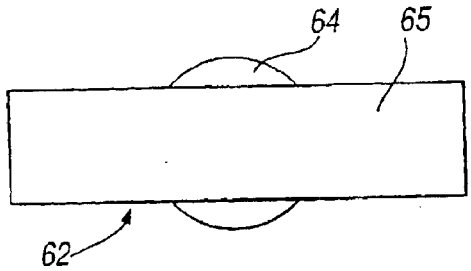
Figure 15A:
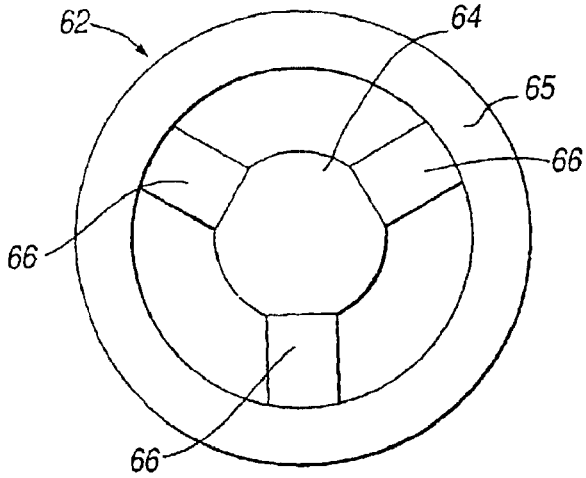

An embodiment of an ink cartridge having a valve element in the form of a valve member adapted to cooperate with a valve seat formed on the cartridge body is illustrated in FIGS. 12 to 15. The body 2 defines a valve seat 61 around the opening of the ink discharge port 8 at the bottom of the recess 9. The valve element 62 which is disposed in this recess includes a spherical valve member 64, a support ring 65 coaxial with and extending around the valve member 64, and a plurality of radial spring fingers 66 interconnecting the valve member and support ring, there being three such fingers in the illustrated embodiment. The valve element is moulded from a resiliently deformable material, the elasticity in the fingers 66 permitting the valve member 64 to be moved relative to the support ring 65. The pen in this embodiment has a stepped socket 26 in which a piston 67 is slidably received, the outer end of the piston being acted upon and urged inwardly by the pen nib 22. When the cartridge 1 is pushed into the pen, the cartridge closure, shown to be a membrane 40 as in FIGS. 9A and 9B, is opened and the nib 22 and piston 67 push the valve member 64 inwardly so that it seals against the valve seat 61 as shown in FIG. 12 so that ink is unable to flow out through the discharge port 8. In use of the pen, the nib is deflected away from the feed bar 21 under the writing pressure exerted against the tip 23 of the nib allowing the valve member 64 to be moved out of sealing contact with the valve seat 61 due to the bias of the spring fingers 66, and thereby opening up the ink flow path to the nib as may be seen in FIG. 13. When the nib 22 is lifted from the paper the nib moves back against the feed bar 21 driving the piston 67 inwardly so that the valve is closed once again.

Modifications are of course possible to the described embodiments, which are given by way of non-limiting example only, without departing from the scope of the invention as defined the claims which follow.

What is claimed is:

1. An ink cartridge for a reservoir pen having a hollow barrel, a feed bar, a nib carried on the feed bar and having a normal position and a flexed position, a socket in the feed bar, and a gush member accommodated in the socket and sized so that the nib in the normal position exerts an inward force on the push member, the ink cartridge comprising:

a body sized for insertion into the pen barrel and defining a chamber adapted to hold ink;

an ink discharge port through which ink from the chamber is discharged from the cartridge; and a resilient valve element coupled to the body and extending across the ink discharge port for controlling flow of ink therethrough, the valve element having an open condition in which the port is opened, and a closed condition in which the valve element is inwardly resiliently deformed to close the ink discharge port, the resilient valve element further being adapted to engage the push member so that the inward force exerted on the push member by the nib urges the valve element to the closed condition.

2. An ink cartridge according to claim 1, wherein the ink discharge port is formed in a side wall of the body at a bottom of an external recess therein, and the valve element is disposed in the recess.

3. An ink cartridge according to claim 1, wherein the valve element is a moulded element of resiliently deformable material.

4. An ink cartridge according to claim 3, wherein the body defines a valve seat and wherein the valve element comprises a valve member for sealing engagement with the body valve seat.

5. An ink cartridge according to claim 4, wherein the valve member is integral with a spring arranged to bias the valve member away from the body valve seat.

6. An ink cartridge according to claim 5, wherein the spring comprises a plurality of spring fingers radiating from the valve member.

7. An ink cartridge according to claim 6, wherein the spring fingers have outer ends connected to a support ring extending around the valve member.

8. An ink cartridge according to claim 3, wherein the pen push member comprises a valve member and wherein the valve element comprises a valve seat adapted for cooperation with the pen valve member.

9. An ink cartridge according to claim 8, wherein the valve seat comprises a disc with an aperture therein for ink to pass through the disc when the valve is open.

10. An ink cartridge according to claim 1, wherein the chamber is sealed at a forward end thereof by a closure which is openable to bring the ink discharge port into communication with the chamber.

11. An ink cartridge according to claim 10, wherein a bore is formed at a forward end of the body and the closure is openable by insertion of a peg carried by the pen into the bore.

12. An ink cartridge according to claim 11, wherein the closure comprises a membrane and is opened by the peg rupturing the membrane.

13. An ink cartridge according to claim 12, wherein the membrane is integral with the body.

14. An ink cartridge according to claim 11, wherein the closure comprises a plug and is opened by the peg displacing the plug.

15. A reservoir pen assembly, comprising:

an ink cartridge having a body enclosing a chamber sealed at a forward end thereof by a closure which is openable, a forward end of the body being formed with a bore; an ink discharge port through which, in use, ink delivered from the chamber is discharged from the cartridge; and a resilient valve element mounted on the body at the ink discharge port for controlling flow of ink therethrough, the valve element having an open condition in which the port is opened, and the valve element being inwardly resiliently deformable for closing the port; and a pen adapted to receive the cartridge, the pen having a peg sized for insertion through the bore to open the closure; wherein the peg defines an ink duct for flow of ink from the chamber to the port, and wherein the peg seals an outer end of the bore.

16. A reservoir pen assembly according to claim 15, wherein the peg includes a groove to form the ink duct.

17. A reservoir comprising:

an ink cartridge having a body enclosing a chamber sealed at a forward end thereof by a closure which is openable, a forward end of the body being formed with a bore; an ink discharge port through which, in use, ink delivered from the chamber is discharged from the cartridge; and a resilient valve element mounted on the body at the ink discharge port for controlling flow of ink therethrough, the valve element having an open condition in which the port is opened, and the valve element being inwardly resiliently deformable for closing the port; and a pen adapted to receive the cartridge, the pen having a peg sized for insertion through the bore to open the closure;

wherein the pen includes a feed bar into which the forward end of the cartridge is inserted, a nib carried on the feed bar and capable of flexing away from the feed bar, a socket in the feed bar, and a push member accommodated in the socket for cooperation with the valve element, the nib being arranged to act on the valve element through the push member so that the element is normally closed and is opened when the nib is deflected away from the feed bar.

* * * * *

UNITED STATES PATENT AND TRADEMARK OFFICE

CERTIFICATE OF CORRECTION

PATENT NO. : 6,863,460 B2
DATED : March 8, 2005
INVENTOR(S) : Nicoll et al.

It is certified that error appears in the above-identified patent and that said Letters Patent is hereby corrected as shown below:

Title page,
Item [57], ABSTRACT,
Line 11, please delete "(3)" and insert -- (5) --.

Column 2,
Line 67, please delete "gust" and insert -- push --.

Signed and Sealed this

Nineteenth Day of July, 2005

JON W. DUDAS
*Director of the United States Patent and Trademark Office*